US009970620B2

(12) United States Patent
Park

(10) Patent No.: US 9,970,620 B2
(45) Date of Patent: May 15, 2018

(54) LIGHTING DEVICE FOR VEHICLE

(71) Applicant: LG Electronics Inc., Seoul (KR)

(72) Inventor: Jun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days. days.

(21) Appl. No.: 15/665,850

(22) Filed: Aug. 1, 2017

(65) Prior Publication Data

US 2018/0038566 A1 Feb. 8, 2018

(30) Foreign Application Priority Data

Aug. 2, 2016 (KR) ..... 10-2016-0098650

(51) Int. Cl.
*F21V 5/00* (2015.01)
*F21S 8/10* (2006.01)

(52) U.S. Cl.
CPC ..... *F21S 48/145* (2013.01); *F21S 48/125* (2013.01); *F21S 48/1225* (2013.01); *F21S 48/13* (2013.01)

(58) Field of Classification Search
CPC ..... F21S 48/145; F21S 48/13; F21S 48/125; F21S 48/1225
USPC ..... 362/521
See application file for complete search history.

(56) References Cited

U.S. PATENT DOCUMENTS 9,128,344 B2 9/2015 Chen
2014/0226352 A1 8/2014 Erdl et al.
2015/0016135 A1 1/2015 Erdl et al.
2015/0285457 A1 10/2015 Erdl et al.
2016/0215947 A1 7/2016 Matsuno

FOREIGN PATENT DOCUMENTS

| | | |
|---|---|---|
| EP | 3048362 | 1/2016 |
| JP | 2002216514 | 8/2002 |
| JP | 3839235 | 11/2006 |
| JP | 2009259431 | 11/2009 |

OTHER PUBLICATIONS

Notice of Allowance issued in Korean Application No. 10-2016-0098650 dated May 30, 2017, 7 pages (with English translation).

*Primary Examiner* — Anh Mai
*Assistant Examiner* — Hana Featherly
(74) *Attorney, Agent, or Firm* — Fish & Richardson P.C.

(57) ABSTRACT

A lighting device for a vehicle includes a light source part that includes: a light source; a reflection unit; a lens having a front surface and a rear surface, wherein the reflection unit is provided on a part of the front surface; and a reflective phosphor disposed behind the rear surface of the lens and configured to convert a wavelength of the light reflected by the reflection unit; and a light distribution part that includes: a collimator lens disposed forward of the front surface of the lens, and configured to collimate the received light to form parallel light rays; a focusing lens disposed forward of the collimator lens and configured to concentrate the received light to form an image forming plane; and a shield disposed at the image forming plane and configured to block at least a part of the light passing through the image forming plane.

10 Claims, 10 Drawing Sheets

LIGHTING DEVICE FOR VEHICLE

CROSS-REFERENCE TO RELATED APPLICATION

This application claims an earlier filing date of and the right of priority to Korean Patent Application No. 10-2016-0098650, filed on Aug. 2, 2016, the contents of which are incorporated herein by reference in its entirety.

TECHNICAL FIELD

The present disclosure relates to a lighting device for a vehicle which shields a part of light emitted from a light source and transmits the rest of the light to the outside.

BACKGROUND

A lighting device, such as a lamp, is installed in a vehicle to help provide a field of vision to a driver by providing illumination of object near the vehicle and notify a current driving state of the vehicle to the outside, such as to other vehicles or pedestrians.

The lighting device installed in the vehicle (hereinafter, referred to as a lighting device for a vehicle) may include a head lamp which emits light in a forward direction of the vehicle, and a rear lamp which indicates the direction of travel of the vehicle or application of a brake.

The lighting device for a vehicle may form a low beam or a high beam to provide outward visibility to a driver during night driving situations. Recently, light-emitting diodes (LEDs) having high power efficiency and a long lifespan have been increasingly incorporated into the lighting device for a vehicle.

A laser diode having a longer irradiation distance than that of an LED may also be used as a light source of the lighting device for a vehicle.

SUMMARY

Implementations disclosed herein provide a compact lighting device for a vehicle implemented using a smaller number of components.

In one aspect, a lighting device for a vehicle includes a light source part that includes: a light source configured to emit light; a reflection unit configured to receive the light emitted by the light source; a lens having a front surface and a rear surface opposite to the front surface, wherein the reflection unit is provided on a part of the front surface and the rear surface is configured to receive the light emitted by the light source; and a reflective phosphor disposed behind the rear surface of the lens and configured to convert a wavelength of the light reflected by the reflection unit and reflect the wavelength-converted light toward the lens; and a light distribution part that includes: a collimator lens disposed forward of the front surface of the lens to receive the wavelength-converted light from the lens, and configured to collimate the received light to form parallel light rays; a focusing lens disposed forward of the collimator lens to receive light from the collimator lens and configured to concentrate the received light to form an image forming plane; and a shield disposed at the image forming plane and configured to block at least a part of the light passing through the image forming plane.

Implementations may include one or more of the following features. For example, an optical axis of the collimator lens and an optical axis of the focusing lens coincide with each other.

In some implementations, the parallel light rays are parallel to an optical axis of the collimator lens.

In some implementations, the parallel light rays are parallel to an optical axis of the focusing lens.

In some implementations, the focusing lens has a convex rear surface and a flat front surface, and the shield is oriented parallel to the front surface of the focusing lens.

In some implementations, the shield is disposed to face a lower portion of a front surface of the focusing lens.

In some implementations, the shield is smaller than the focusing lens.

In some implementations, the lighting device includes a projection lens disposed in front of the focusing lens, the projection lens having a convex front surface.

In some implementations, the image forming plane is positioned between the projection lens and the focusing lens.

In some implementations, the collimator lens, the focusing lens, and the projection lens have respective optical axes that coincides with one another.

The details of one or more implementations are set forth in the accompanying drawings and the description below. Other features will be apparent from the description and drawings, and from the claims. The description and specific examples below are given by way of illustration only, and various changes and modifications will be apparent.

BRIEF DESCRIPTION OF THE DRAWINGS

Like reference symbols in the various drawings indicate like elements.

DETAILED DESCRIPTION

Various implementations of a lighting device for a vehicle is described herein.

In some implementations, a lighting device for a vehicle may be implemented using a smaller number of components, and may be made compact.

In some implementations, a light distribution part for generating a low beam may be configured without a mirror, resulting is a reduction of size of the light distribution part.

In some implementations, size of a lens can be reduced to make the lighting device more compact by reducing a beam size of the light using a light reducer.

In accordance with an implementation of the present disclosure, a lighting device for vehicle may include a light source part and a light distribution part, wherein the light source part comprises: a light source; a reflection unit on which light emitted by the light source is incident; a lens having a front surface, wherein the reflection unit is provided on a part of the front surface; and a reflective phosphor disposed behind the lens and configured to convert a wavelength of light reflected by the reflection unit and reflect the wavelength-converted light toward the lens, and wherein the light distribution part may include: a collimator lens disposed in front of the lens and configured to emit light, incident from the lens, in a form of parallel light rays; a focusing lens disposed in front of the collimator lens and configured to concentrate light, incident from the collimator lens, so as to form an image forming plane; and a shield disposed at the image forming plane and configured to shield at least part of light passing through the image forming plane.

Figure 1:
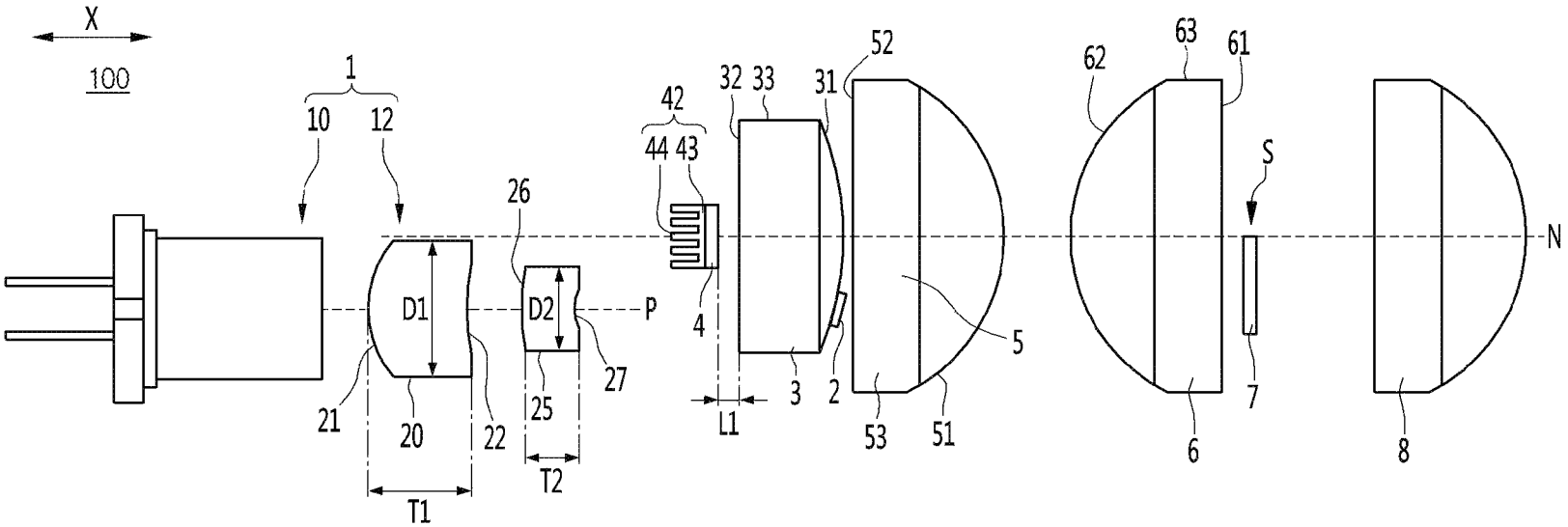
FIG. 1 is a configuration diagram illustrating an example of a lighting device for a vehicle according to a first implementation of the present disclosure.
Figure 2:
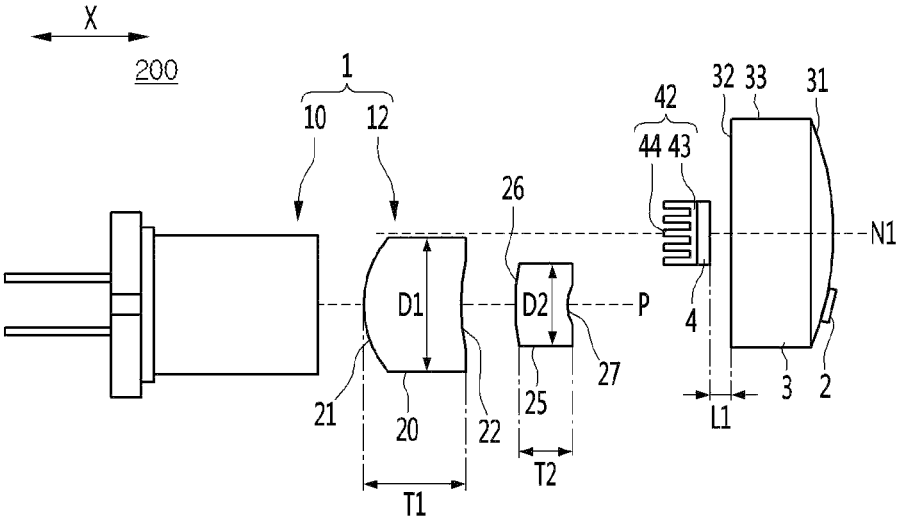
FIG. 2 is a configuration diagram illustrating an example of a light source part of a lighting device for a vehicle according to a first implementation of the present disclosure.
Figure 3:
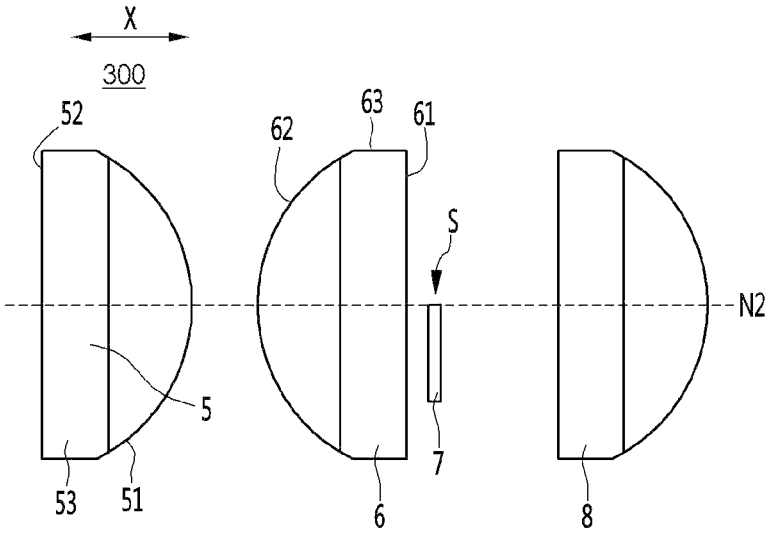
FIG. 3 is a configuration diagram illustrating an example of a light distribution part of the lighting device for a vehicle according to the first implementation of the present disclosure.
Figure 4:
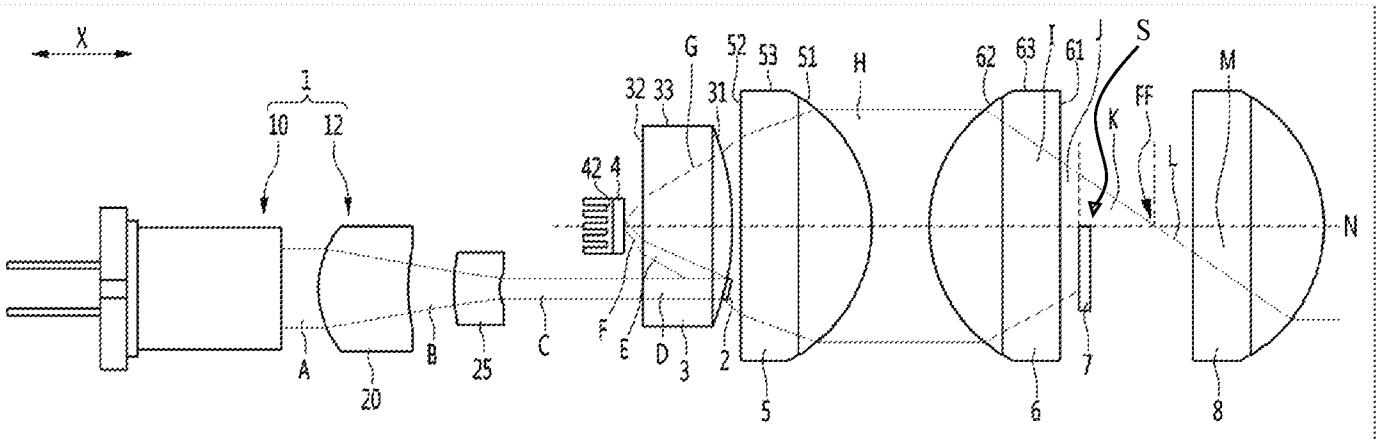
FIG. 4 is a configuration diagram illustrating optical paths in an example of a lighting device according to the first implementation of the present disclosure.
Figure 5:
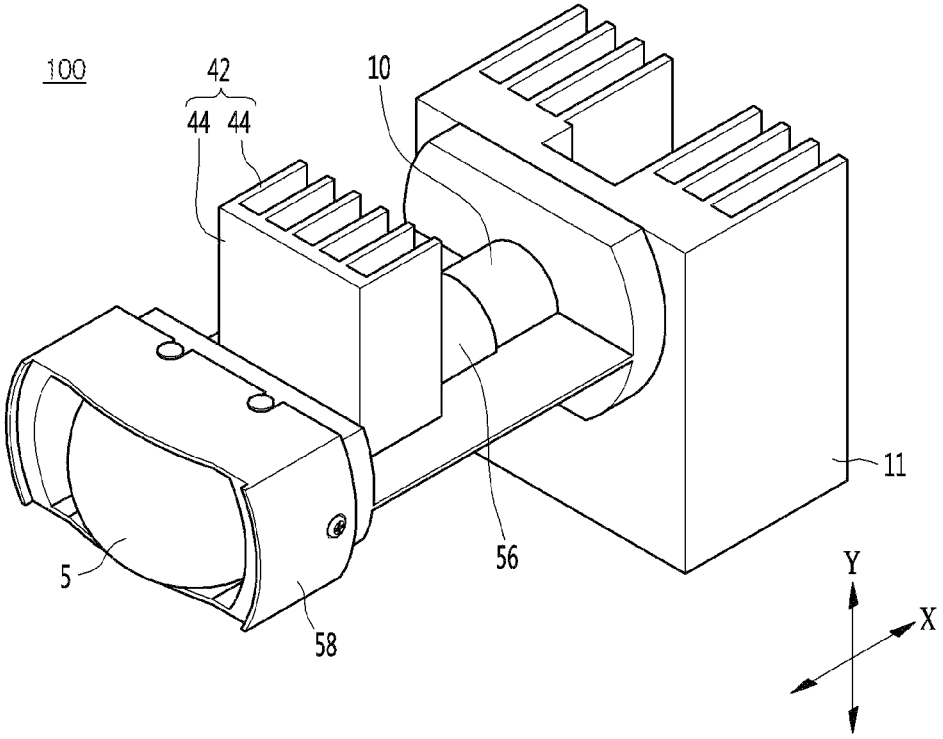
FIG. 5 is a perspective view illustrating an example of the lighting device for a vehicle according to the first implementation of the present disclosure.

FIG. 1 illustrates an example of a lighting device for a vehicle according to a first implementation of the present disclosure; FIG. 2 illustrates a light source part of a lighting device for a vehicle according to a first implementation of the present disclosure; FIG. 3 illustrates an example of a light distribution part of the lighting device for a vehicle according to the first implementation of the present disclosure; FIG. 4 illustrates optical paths in an example of a lighting device according to the first implementation of the present disclosure; and FIG. 5 illustrates an example of the lighting device for a vehicle according to the first implementation of the present disclosure.

Referring to FIG. 1, a lighting device 100 for vehicle may include a light source device 1, a reflection unit 2, a lens 3, a reflective phosphor 4, a collimator lens 5, a focusing lens 6, and a shield 7.

In general, referring to FIGS. 2 and 3, the lighting device 100 for vehicle may consist of a light source part 200 and a light distribution part 300. The light source part 200 may include the reflection unit 2, the lens 3, and the reflective phosphor 4. In some implementations, the light source part 200 may further include the collimator lens 5.

The lighting device 100 for vehicle may be used in a headlamp of a vehicle, or may be used as a high beam device for generating and emitting a high beam or a low beam device for generating and emitting a low beam.

The light source device 1 may emit light toward the reflection unit 2. The light source device 1 may emit light toward the lens 3, and the light emitted toward the lens 3 may pass through the lens 3 and be then incident on the reflection unit 2. The light source device 1 may emit light toward a rear surface 32 of the lens 3, and the light incident on the rear surface 32 of the lens 3 from the light source device 1 may pass through the lens 3 and be then incident on a rear surface of the reflection unit 2. The direction of propagation of light in these cases may correspond to a forward direction.

The light source device 1 may include a light source 10. The light source 10 receives electrical energy and convert the electrical energy into optical energy. Examples of the light source 10 include light-emitting sources such as an ultra high voltage (UHV) mercury lamp, a light-emitting diode (LED), or a laser diode.

It is preferable that the light source 10 is highly collimated, have high efficiency, and enables long-distance illumination. For example, such a light source may be provided using a laser diode. In addition, a laser diode that emits in the blue region of the visible spectrum with high efficiency is preferred.

The light source 10 may be coupled to a dissipation member configured to dissipate heat generated by the light source 10. The dissipation member may include a contact plate which comes into contact with the light source 10, and dissipation fins which protrude from the contact plate.

The light source device 1 may further include a light reducer 12 configured to reduce the size of light emitted from the light source 10 and output resultant light toward the reflection unit 2. In other words, the light reducer 12 may reduce a beam size, e.g., diameter, of the light emitted from the light source 10. The light emitted from the light source 10 may pass through the light reducer 12 and then propagate toward the reflection unit 2. The light reducer 12 will be later described in more detail.

The lens 3 may be larger than the reflective phosphor 4 and the reflection unit 2, and may be disposed in front of the reflective phosphor 4 to protect the reflective phosphor 4 and the reflection unit 2.

The lens 3 may have a circular or polygonal shape. The lens 3 may include a front surface 31, a rear surface 32, and a circumferential surface 33.

The front surface 31 of the lens 3 may be a curved surface that is convex toward the front of the lens 3. In some implementations, the rear surface 32 of the lens 3 may be a flat surface or a curved surface that is concave toward the front of the lens 3.

The lens 3 may have an optical axis N1. The optical axis N1 of the lens 3 may be a rotational symmetry axis or a central axis of the lens 3 and may mean a straight line passing through the center of the front surface 31 of the lens 3 and the center of the rear surface 32 of the lens 3. The lens 3 may be a condenser lens having a convex front surface 31, and the front surface of the lens 3 may be symmetric with respect to the optical axis N1.

Referring back to FIG. 1, the lighting device 100 for vehicle may further include the collimator lens 5 disposed in front of the lens 3.

The collimator lens 5 may be larger than the lens 3. The optical axis of the collimator lens 5 may coincide with the optical axis N1 of the lens 3.

The collimator lens 5 includes a front surface 51, a rear surface 52, and a circumferential surface 53. The front surface 51 of the collimator lens 5, for example, may be a curved surface convex toward the front of the collimator lens 5. The rear surface 52 of the collimator lens 5, for example, may be a flat surface. The collimator lens 5 may be symmetric with respect to its own optical axis.

Referring to FIG. 2, the reflective phosphor 4 may be disposed behind the lens 3, and is configured to convert a wavelength of light reflected by the reflection unit 2 and reflect the light having the converted wavelength toward the lens 3.

Heat may be generated during the wavelength conversion process. Accordingly, the reflective phosphor 4 is preferably spaced apart from the lens 3. For example, the reflective phosphor 4 may be disposed behind the lens 3 while being spaced apart from the lens 3. More specifically, the reflective phosphor 4 may be disposed to face the rear surface 32 of the lens 3, and reflect light toward the rear surface 32 of the lens 3.

In some implementations, the reflective phosphor 4 may be disposed on the optical axis N1 of the lens 3 while being spaced apart from the rear surface 32 of the lens 3. A front surface of the reflective phosphor 4 may be parallel to the rear surface 32 of the lens 3.

Alternatively, the reflective phosphor 4 may be disposed off of the optical axis N1 of the lens 3. However, in this case, the resulting efficiency may be lower because a region of the lens 3 through which the light reflected by the reflective phosphor 4 passes is smaller than the case where the reflective phosphor 4 is disposed on the optical axis N1 of the lens 3.

In addition, in the case where the reflective phosphor 4 is disposed off of the optical axis N1 of the lens 3, a region of the collimator lens 5 through which light reflected by the reflective phosphor 4 passes may be asymmetric to the rest region of the collimator lens 5. Such asymmetry may contribute to more complexity and expense in manufacturing the collimator lens 5.

In contrast, if the reflective phosphor 4 is disposed on the optical axis N1 of the lens 3, the collimator lens 5 may be formed to be symmetric with respect to the optical axis, leading to a potential reduction in the manufacturing cost of the collimator lens 5. Therefore, the reflective phosphor 4 is preferably disposed on the optical axis N1 of the lens 3.

Now turning to the reflective phosphor, the reflective phosphor 4 may include a wavelength conversion layer facing the rear surface 32 of the lens 3, and a phosphor reflection unit disposed behind the wavelength conversion layer.

The wavelength conversion layer may be a wavelength conversion film and may include an opto-ceramic. The wavelength conversion layer may be disposed (e.g., rearward of the reflection unit 2) to face a reflecting surface of the reflection unit 2 and convert a wavelength of light reflected by the reflection unit 2. The wavelength conversion layer may be a wavelength conversion film that converts incident light of the blue wavelength band ("blue light") into light of the yellow wavelength band ("yellow light"). The wavelength conversion layer may include a yellow opto-ceramic.

The phosphor reflection unit may include a plate and a reflective coating layer coated on an outer surface of the plate. For example, the plate may be made of metal. The phosphor reflection unit of the reflective phosphor 4 may support the wavelength conversion layer, and light passing through the wavelength conversion layer may be reflected by the phosphor reflection unit toward the rear surface 32 of the lens 3.

When blue light is reflected by the reflection unit 2 toward the reflective phosphor 4, a part of the blue light is reflected by the surface of the wavelength conversion layer. The remaining part of the blue light then enters the wavelength conversion layer, excites the wavelength conversion layer, and is converted into yellow light. The converted yellow light may be reflected by the phosphor reflection unit toward the front of the wavelength conversion layer.

The mixture of the blue light reflected from the surface of the wavelength conversion layer and the yellow light emitted toward the front of the wavelength conversion layer may produce white light that is emitted toward the front of the reflective phosphor 4. The white light may pass through the lens 3 and then be output toward the front of the lens 3.

A front-to-rear width of the lighting device for a vehicle may depend on a distance L1 between the reflective phosphor 4 and the lens 3, and it is preferable that the reflective phosphor 4 is disposed in close proximity to the lens 3 while mitigating thermal damage to the lens 3.

The reflective phosphor 4 may include a dissipation member 42 that helps dissipation of the reflective phosphor 4. The dissipation member 42 may include a contact plate 43 which comes into contact with the reflective phosphor 4, and a dissipation fin 44 protruding from the contact plate 43. For example, the contact plate 43 may be attached to the rear surface of the reflection unit 2 to promote efficient conduction of heat away from the reflective phosphor 4.

The reflection unit 2 may be provided to reflect incident light toward the reflective phosphor 4. In some implementations, the reflection unit 2 may be integrated with the lens 3. In some implementations, the reflector 2 may be spaced apart from the lens 3.

The position of the reflection unit 2 may depend on the position of the reflective phosphor 4. For example, in the case where the reflective phosphor 4 is disposed behind the lens 3, the reflection unit 2 may be disposed behind and spaced apart from the lens 3. Other examples of the location of the reflection unit 2 include the rear surface of the lens 3, the front surface of the lens 3, and in front of the lens 3 while being spaced apart from the lens 3.

In cases where the reflection unit 2 is disposed behind the lens 3 while being spaced apart from the lens 3, the reflection unit 2 may reflect light, emitted by the light source device 1, toward a space between the reflective phosphor 4 and the lens 3.

In cases where the reflection unit 2 is provided on the rear surface of the lens 3 and integrated with the lens 3, the reflection unit 2 may reflect light, emitted by the light source device 1, toward a space between the reflective phosphor 4 and the lens 3.

In cases where the reflection unit 2 is provided on the front surface of the lens 3 and integrated with the lens 3, the reflection unit 2 may reflect light, emitted by the light source device 1 and passing through the lens 3, toward the lens 3 so that the reflected light is reflected again toward the reflective phosphor 4.

In cases where the reflection unit 2 is disposed in front of the lens 3 while being spaced apart from the lens 3, the reflection unit 2 may reflect light, emitted by the light source device 1 and passing through the lens 3, toward the lens 3 so that the reflected light is reflected again toward the reflective phosphor 4.

In cases where the reflection unit 2 is disposed in front of or behind the lens 3 while being spaced apart from the lens 3, additional components may be required for the lighting device for a vehicle. Additionally, the lighting device may potentially be larger in size due to the separation between the lens 3 and the reflection unit 2.

Accordingly, the reflection unit 2 is preferably integrated with the rear surface 32 or the front surface 31 of the lens 3 to make the lighting device compact with reduced number of components.

In the case where the reflection unit 2 is provided on the entire rear surface or the entire front surface of the lens 3, the reflection unit 2 may reflect light reflected by the reflective phosphor 4 in a backward direction, so that the light reflected by the reflective phosphor 4 cannot be output through the front surface of the lens 3.

Accordingly, the reflection unit 2 is preferably provided on a part of the rear surface of the lens 3 or a part of the front surface of the lens 3. Additionally, the reflection unit 2 is preferably large enough for the lens 3 to secure a sufficient light emission region. Furthermore, the reflection unit 2 is preferably disposed off of the optical axis N1 of the lens 3. In addition, the reflection unit 2 is preferably disposed between the optical axis N1 and the circumferential surface 33 of the lens 3.

The reflection unit 2 may be provided on a part of the rear surface of the lens 3 or a part of the front surface of the lens 3. The reflection unit 2 may be configured to reflect light, emitted by the light source device 1, toward the reflective phosphor 4.

The reflection unit 2 may reflect the incident light toward the rear side of the lens 3.

The position of the reflection unit 2 is preferably determined by considering a distance between the reflective phosphor 4 and the lens 3. For example, since the reflective phosphor 4 is preferably disposed close to the rear surface 32 of the lens 3, it is preferable that the reflection unit 2 is provided on the front surface 31 of the lens 3.

In such a configuration, the reflection unit 2 may be provided on a part of the front surface of the lens 3, and light emitted by the light source device 1, especially the light reducer 12, may pass through the lens 3 and be then incident on the reflection unit 2. In addition, the light reflected by the reflection unit 2 may pass through the lens 3 and be then incident on the reflective phosphor 4. Light whose wavelength is converted by the reflective phosphor 4 may pass through the lens 3 and be then emitted forward.

In such a configuration, the lens 3 may be a 3-path lens through which light passes three times, and the lighting lamp for vehicle may be made compact due to the 3-path lens.

In cases where the reflection unit 2 is formed on a part of a convex front surface 31 of the lens, the reflection unit may be formed to have an arc-shaped cross section that correspond to the convex front surface 31. Additionally, when viewed from a front viewpoint of the lens 3, the reflection unit 2 may have a circular or polygonal shape.

The reflection unit 2 may be a concave mirror formed in the front surface 31 of the lens 3. The reflection unit 2 may have a convex front surface and a concave rear surface.

The front surface of the reflection unit 2 may face the collimator lens 5, which will be described later, and may be disposed between the lens 3 and the collimator lens 5 such that the reflection unit 2 is protected.

In some implementations, the reflection unit 2 may be a reflective coating layer coated on the front surface 31 of the lens 3 while avoiding a region around the optical axis N1 of the lens 3. In some implementations, the reflection unit 2 may be a reflection sheet attached to the front surface 31 of the lens 3, while avoiding a region around the optical axis N1 of the lens 3.

The light reducer 12 may be disposed between the lens 3 and the light source 10. For example, the light reducer 12 may be disposed between the rear surface 32 of the lens 3 and a front surface of the light source 10 while being spaced apart from the lens 3 and the light source 10, respectively.

The light reducer 12 may be spaced apart from the optical axis N1 of the lens 3. For example, a part of the light reducer 12 may fall on the optical axis N1 of the lens 3, but an optical axis P of the light reducer 12 may be spaced apart from the optical axis N1 of the lens 3.

The light reducer 12 may be disposed behind the lens 3 and configured to transmit light in a direction parallel to the optical axis N1 of the lens 3. To this end, the optical axis P of the light reducer 12 may be parallel to the optical axis N1 of the lens 3.

In some implementations, the light reducer 12 may include a first reducer lens 20 configured to reduce a width of light emitted from the light source 10; and a second reducer lens 25 which is spaced apart from the first reducer lens 20 and configured to reduce a width of light transmitted by the first reducer lens 20. While a reduction in width of light is described here, in general, a diameter or size of light emitted by the light source may be reduced by the light reducer 12.

The first reducer lens 20 includes a light entrance surface 21 and a light exit surface 22, and the second reducer lens 25 includes a light entrance surface 26 and a light exit surface 27.

The light exit surface 22 of the first reducer lens 20 and the light entrance surface 26 of the second reducer lens 25 may be spaced apart from each other. For example, the light exit surface 22 of the first reducer lens 20 and the light entrance surface 26 of the second reducer lens 25 may be spaced apart from each other along a direction parallel to the optical axis N1 of the lens 3. The separation between the first reducer lens 20 and the second reducer 25 may be an air gap.

As another example, the first reducer lens 20 and the second reducer lens 25 may be spaced apart from each other in a front-to-rear direction. The light exit surface 22 of the first reducer lens 20 and the light entrance surface 26 of the second reducer lens 25 may be spaced apart from each other in the front-to-rear direction.

The first reducer lens 20 may be disposed between the light source 10 and the second reducer lens 25, and the second reducer lens 25 may be disposed between the first reducer lens 20 and the lens 3. In such a configuration, the light entrance surface 21 of the first reducer lens 20 may face the light source 10.

The optical axis P of the first reducer lens 20 may coincide with the optical axis of the second reducer lens 25.

The light exit surface 27 of the second reducer lens 25 may face the rear surface 32 of the first lens 3. The light exit surface 27 of the second reducer lens 25 preferably does not face the dissipation member 42 or the reflective phosphor 4.

Each of the first reducer lens 20 and the second reducer lens 25 may have a convex light entrance surface. Each of the first reducer lens 20 and the second reducer lens 25 may have a concave light exit surface through which light is output.

The rear surface of the first reducer lens 20 may be a light entrance surface 21 that is a curved surface concave toward the rear of the first reducer lens 20. Light incident from the light source 10 may be refracted by the convex light entrance surface 21 such that the light passing through the first reducer lens 20 is progressively reduced in width or diameter, as shown in FIG. 4.

The front surface of the first reducer lens 20 may be a light exit surface 22 that is a curved surface concave toward the rear of the first reducer lens 20. The light exit surface 22 may be concave over its entire surface, or concave over a central region of the light exit surface 22.

A part of the light exit surface 22 of the first reducer lens 20 may face the light entrance surface 26 of the second reducer lens 25.

The rear surface of the second reducer lens 25 may be a light entrance surface 26 that is a curved surface convex toward the rear of the second reducer lens 25. Light output by the first reducer lens 20 and passed through the air between the first reducer lens 20 and the second reducer lens 25 may be refracted by the convex light entrance surface 26 of the second reducer lens 25, and light passing through the second reducer lens 25 may be progressively reduced in width or diameter.

The front surface of the second reducer lens 25 may be a light exit surface 27 that is a curved surface concave toward the rear of the second reducer lens 25. The light exit surface 27 may be concave over its entire surface, or concave over a central region of the light exit surface 27.

The entire light exit surface 27 of the second reducer lens 25 may face the rear surface 32 of the lens 3.

A diameter D2 of the second reducer lens 25 may be smaller than a diameter D1 of the first reducer lens 20. A thickness T2 of the second reducer lens 25 may be thinner than a thickness T1 of the first reducer lens 20.

Since light is primarily reduced by the first reducer lens 20, the second reducer lens 25 may be formed smaller than the first reducer lens 20 in order to increase efficiency in use of an interior space of the vehicle lamp.

The light entrance surface 21 of the first reducer lens 20 and the light entrance surface 26 of the second reducer lens 25 may have the same curvature or a different curvature.

A degree of reduction in width of light passing through the first reducer lens 20 may primarily depend on a curvature of the light entrance surface 21 of the first reducer lens 20. For example, by increasing the curvature of the light entrance surface 21 of the first reducer lens 20, the width or diameter of light passing through the first reducer lens 20 may be further reduced.

Accordingly, by increasing the curvature of the light entrance surface 21 of the first reducer lens 20, the size of the second reducer lens 25, the reflection unit 2, and the lens 3 may be reduced.

Light whose width is primarily reduced by the first reducer lens 20 may be incident on the light entrance surface 26 of the second reducer lens 25. Accordingly, the light entrance surface 26 of the second reducer lens 25 is preferably formed not to excessively reduce the width of the light.

For example, in the case where the light entrance surface 21 of the first reducer lens 20 and the light entrance surface 26 of the second reducer lens 25 have different respective curvatures, the curvature of the light entrance surface 21 of the first reducer lens 20 is preferably greater than a curvature of the light entrance surface 26 of the second reducer lens 25.

The light exit surface 22 of the first reducer lens 20 and the light exit surface 27 of the second reducer lens 25 may have the same curvature or a different curvature.

A width of light output by the first reducer lens 20 may vary depending on the curvature of the light exit surface 22 of the first reducer lens 20.

The light exit surface 22 of the first reducer lens 20 may have a curvature where light passing through the light exit surface 22 is output in a direction parallel to the optical axis of the first reducer lens 20. In addition, the light exit surface 22 of the first reducer lens 20 may have a curvature configured such that a width of light passing through the light exit surface 22 of the first reducer lens 20 is progressively reduced between the light exit surface 22 of the first reducer lens 20 and the light entrance surface 26 of the second reducer lens 25.

A width of light incident on the reflection unit 2 may vary depending on a curvature of the light exit surface 27 of the second reducer lens 25. The light exit surface 27 of the second reducer lens 25 is preferably shaped to allow light passing through the light exit surface 27 of the second reducer lens 25 to be incident on the reflection unit 2 in a direction parallel to the optical axis of the second reducer lens 25.

In the case where the light exit surface 22 of the first reducer lens 20 and the light exit surface 27 of the second reducer lens 25 have different respective curvatures, the curvature of the light exit surface 27 of the second reducer 25 is preferably greater than the curvature of the light exit surface 22 of the first reducer lens 20.

Referring to FIG. 5, the lighting device for a vehicle may further include a light reducer supporter 56 that supports the light reducer 12.

The light reducer supporter 56 may be formed to surround the light reducer 12. The light reducer supporter 56 may be elongated in a direction parallel to the optical axis N1 of the lens 3 (e.g., along the x-axis), and a light transmission passage through which light passes may be formed inside the light reducer supporter 56.

In addition, the lighting device for a vehicle may further include a lens holder 58 that supports the lens 3 and the collimator lens 5.

Referring back to FIG. 3, the light distribution part 300 may include a focusing lens 6, a shield 7, and a projection lens 8. In addition, the light distribution part 300 may further include the collimator lens 5. The collimator lens 5 may be included in the light source part 200 or the light distribution part 300.

The collimator lens 5 may output light received at the rear surface 32 (i.e., light incident on the rear surface 52) in the form of parallel light rays. In other words, the collimator lens 5 collimates the light received at the rear surface 32. For example, the parallel light rays may be parallel to the optical axis of the collimator lens 5.

The light incident on the rear surface 52 of the collimator lens 5 may be light output by the lens 3. The light output by the lens 3 may be non-parallel light rays, such as scattered light.

The focusing lens 6 may be disposed in front of the collimator lens 5.

An optical axis N2 of the focusing lens 6 may coincide with the optical axis of the collimator lens 5. Alternatively, a front surface 61 of the focusing lens 6 and the rear surface 52 of the collimator lens 5 may be oriented parallel to each other.

The parallel light rays may be parallel to the optical axis N2 of the focusing lens 6.

The focusing lens 6 may include the front surface 61, a rear surface 62, and a circumferential surface 63. The front surface 61 of the focusing lens 6, for example, may be a flat surface. The rear surface 62 of the focusing lens 6, for example, may be a curved surface concave toward the rear of the focusing lens 6. The focusing lens 6 may be symmetric with respect to the optical axis N2.

The focusing lens 6 may concentrate the light incident on the rear surface 62, and output the concentrated light. For example, the focusing lens 6 may concentrate light incident on the rear surface 62 to an image forming plane S. The image forming plane S of the focusing lens 6 may be formed in front of (i.e., forward of) the focusing lens 6.

The image forming plane S may be a plane where an optical image is formed. If a screen 9 is located at the image forming plane, an image may be formed on the screen 9.

By concentrating light incident on the rear surface 62, the focusing lens 6 may form a focus FF. The focus FF correspond to a point at which parallel rays of light incident on the rear surface 62 of the focusing lens 6 converge. The focus FF of the focusing lens 6 may be formed on the front side of the focusing lens 6.

The shield 7 may be disposed in front of the focusing lens 6. The shield 7 may be a flat member. For example, the shield 7 may be oriented parallel to the front surface 61 of the focusing lens 6. As another example, the shield 7 may be oriented parallel to the rear surface 52 of the collimator lens 5. As yet another example, the shield 7 may be oriented perpendicular to the optical axis N2 of the focusing lens 6.

The shield 7 may shield, or block, a part of light that passes through the image forming plane S of the focusing lens 6. That is, a pattern of light passing through the image forming plane S may vary depending on a shape of the shield 7. Accordingly, various light distribution patterns may be realized by changing the shape of the shield 7.

The shield 7 may be disposed to face a lower portion of the front surface 61 of the focusing lens 6. The focusing lens 6 may be divided along a plane that includes the optical axis N2 into an upper portion and a lower portion. The upper portion is a portion above the optical axis N2, and the lower portion is a portion below the optical axis N2.

The shield 7 may be a member including a flat surface, and the front surface 61 of the focusing lens 6 may be a flat surface. The fact that the shield 7 is disposed to face the front surface 61 of the focusing lens 6 may mean that the flat surface of the shield 7 and the front surface 61 of the focusing lens 6 can be disposed parallel to each other.

Accordingly, the shield 7 may be disposed parallel to the front surface 61 of the focusing lens 6 and face a portion of the focusing lens 6 below the optical axis N2 of the focusing lens 6.

By disposing the shield 7 to face the lower portion of the front surface 61 of the focusing lens 6, the light distribution part 300 may implement a low beam.

The image forming plane S of the focusing lens 6 may be spaced apart at a predetermined distance from the front surface 61 of the focusing lens 6. As the focusing lens 6 is configured to concentrate rays of light, the size of light passing through the focusing lens 6 may be reduced relative to the size of light incident on the rear surface 62 of the focusing lens 6.

Accordingly, the shield 7 may be smaller than the focusing lens 6. For example, the shield 7 may be smaller than the front surface 61 of the focusing lens 6.

The light distribution part 300 may further include the projection lens 8. The projection lens 8 may include a front surface, a rear surface, and a circumferential surface. The front surface of the projection lens 8, for example, may be a curved surface convex toward the front of the projection lens 8. The rear surface of the projection lens 8, for example, may be a flat surface. The projection lens 8 may be symmetric with reference to its own optical axis.

The optical axis of the projection lens 8 may coincide with the optical axis N2 of the focusing lens 6. Alternatively, the optical axis of the projection lens 8 may coincide with the optical axis of the collimator lens 5.

The rear surface of the projection lens 8, for example, may be parallel to the front surface 61 of the focusing lens 6. As another example, the rear surface of the projection lens 8 may be parallel to the rear surface 52 of the collimator lens 5.

The shield 7 may be disposed to face a lower portion of the rear surface of the projection lens 8. The projection lens 8 may be divided along a plane that includes its optical axis into an upper portion and a lower portion. The upper portion may be a portion above the optical axis, and the lower portion may be a portion below the optical axis.

The shield 7 may be a member including a flat surface, and the rear surface of the projection lens 8 may be a flat surface. In this case, the fact that the shield 7 is disposed to face the rear surface of the projection lens 8 may mean that the flat surface of the shield 7 and the rear surface of the projection lens 8 may be disposed parallel to each other.

Thus, the shield 7 may be disposed parallel to the projection lens 8 and face a portion of the projection lens 8 below the optical axis of the projection lens 8.

The projection lens 8 may be disposed such that the image forming plane S of the focusing lens 6 is positioned between the projection lens 8 and the focusing lens 6.

The focus FF of the focusing lens 6 may be formed on the front side of the focusing lens 6. The projection lens 8 can then be disposed such that the focus FF of the focusing lens 6 is positioned between the projection lens 8 and the focusing lens 6.

In some implementations of the light distributing unit, the collimator lens 5, the focusing lens 6, the shield 7, and the projection lens 8 may be sequentially arranged along the X-axis in the respective order.

In some implementations, the light source part 200 and the light distribution part 300 may form one light emitting device 100. The light emitting device 100 may be configured such that the light source part 200 and the light distribution part 300 are arranged along the X-axis in the respective order.

The optical axis N1 of the lens 3 and the optical axis of the collimator lens 5 may coincide with each other. In addition, the optical axis N1 of the lens 3 and the optical axis N2 of the focusing lens 6 may coincide with each other.

The lens 3, the collimator lens 5, the focusing lens 6, and the projection lens 8 may have respective optical axes coinciding with one other. For example, the respective optical axes may be provided by the optical axis N.

Since light output from the lens 3 and incident on the rear surface 52 of the collimator lens 5 may be diverging, the collimator lens 5 may be larger than the lens 3. In addition, the focusing lens 6 may be larger than the lens 3.

Hereinafter, an operation of the aforementioned configuration will be described in reference to FIG. 4. For the purpose of the description, it is assumed that the light source 10 emits blue light and the reflective phosphor 4 converts the blue light into yellow light, but the description of the operation is applicable to other colors of light in general.

First of all, when the light source 10 is turned on, blue light A may be emitted by the light source 10. The light A emitted by the light source 10 may be incident on the light reducer 12 in a direction parallel to the optical axis of the light source 10.

The light A emitted by the light source 10 in the direction parallel to the optical axis of the light source 10 may be incident on the light entrance surface 21 of the first reducer lens 20, and may be refracted by the light entrance surface 21 of the first reducer lens 20 such that the width of the light A is reduced.

The light refracted by the light entrance surface 21 of the first reducer lens 20 may propagate through the first reducer lens 20 and exit the first reducer lens 20 through the light exit surface 22 of the first reducer lens 20.

Light B output by the light exit surface 22 of the first reducer lens 20 may be incident on the light entrance surface 26 of the second reducer lens 25 in a direction parallel to the optical axis of the second reducer lens 25. Alternatively, the light B may be progressively reduced in width between the light exit surface 22 of the first reducer lens 20 and the light entrance surface 26 of the second reducer lens 25, which is then incident on, or received by, the light entrance surface 26 of the second reducer lens 25.

The light incident on the light entrance surface 26 of the second reducer lens 25 may propagate through the second reducer lens 25 and exit from the second reducer lens 25 through the light exit surface 27 of the second reducer lens 25 in the direction parallel to the optical axis of the second reducer lens 25.

In other words, the light A emitted by the light source 10 may be reduced in width while propagating through the first reducer lens 20, the air between the first reducer and the second reducer, and the second reducer lens 25 in the respective order. Light C having a reduced width may be incident on the rear surface 32 of the lens 3 in a direction parallel to the optical axis of the second reducer lens 25.

Light C then enters the lens 3 through the rear surface 32 and becomes light D. Light D propagates through the lens 3 and is then incident on the rear surface of the reflection unit 2. The light D may be reflected from the rear surface of the reflection unit 2 toward the lens 3 as light E.

Light E reflected by the reflection unit 2 may be reflected in a direction toward the optical axis N1 of the lens 3 and refracted by the rear surface 32 of the lens 3 as light F.

Light F refracted by the rear surface 32 of the lens 3 may propagate from the rear surface 32 of the lens 3 to the reflective phosphor 4 to be incident on the reflective phosphor 4.

Then a wavelength of the light F incident on the reflective phosphor 4 may be converted by the reflective phosphor 4, and white light may be emitted by the reflective phosphor 4 toward the rear surface 32 of the lens 3.

The light emitted by the reflective phosphor 4 toward the rear surface 32 of the lens 3 may propagate through the lens 3 as light G, which then may pass through the front surface 31 of the lens 3 and be then incident on the collimator lens 5 through the rear surface 52 of the collimator lens 5.

The light incident on the collimator lens 5 may propagate through the collimator lens 5 and then be refracted by the front surface 51 of the collimator lens 5 to be output toward the front of the collimator lens 5 in a direction parallel to the optical axis of the collimator lens 5.

Light H output toward the front of the collimator lens 5 may be parallel light rays. The light H may then be incident on the focusing lens 6 through the rear surface 62 of the focusing lens 6 as light I.

Light I incident on the focusing lens 6 may be refracted by the rear surface 62 and propagates through the focusing lens 6. At this point, the light I may be converging due to the refraction by the rear surface 62. Light I then exits the focusing lens 6 through the front surface 61 of the focusing lens 6 to be output toward the front side of the focusing lens 6 as light J.

Light J output toward the front side of the focusing lens 6 may pass through the image forming plane S and the focus FF. A part of the light J output toward the front of the focusing lens 6 may be shielded by the shield 7 disposed at the image forming plane S.

The shield 7 may be disposed to face the lower portion of the front surface 61 of the focusing lens 6. At the image forming plane S, a part of the light J propagating through a portion below the optical axis of the focusing lens 6, may be shielded, or blocked, by the shield 7. The remaining part of light J that is not blocked by the shield 7, e.g., portion of light propagating above the optical axis N2 of the focusing lens 6, propagates forward as light K.

The light K not blocked by the shield 7 may converge at one point when passing through the focus FF, and then propagate below the optical axis N2 of the focusing lens 6.

Light L propagating below the optical axis N2 of the focusing lens 6 may be incident on the projection lens 8 through the rear surface of the projection lens 8.

Light M incident on the projection lens 8 may propagate through the projection lens 8 and then be refracted by the front surface of the projection lens 8 to be output toward the front side of the projection lens 8 in a direction parallel to the optical axis of the projection lens 8.

The light output toward the front side of the projection lens 8 may be a low beam. In addition, the light output toward the front side of the projection lens 8 may be parallel light rays.

Figure 6:
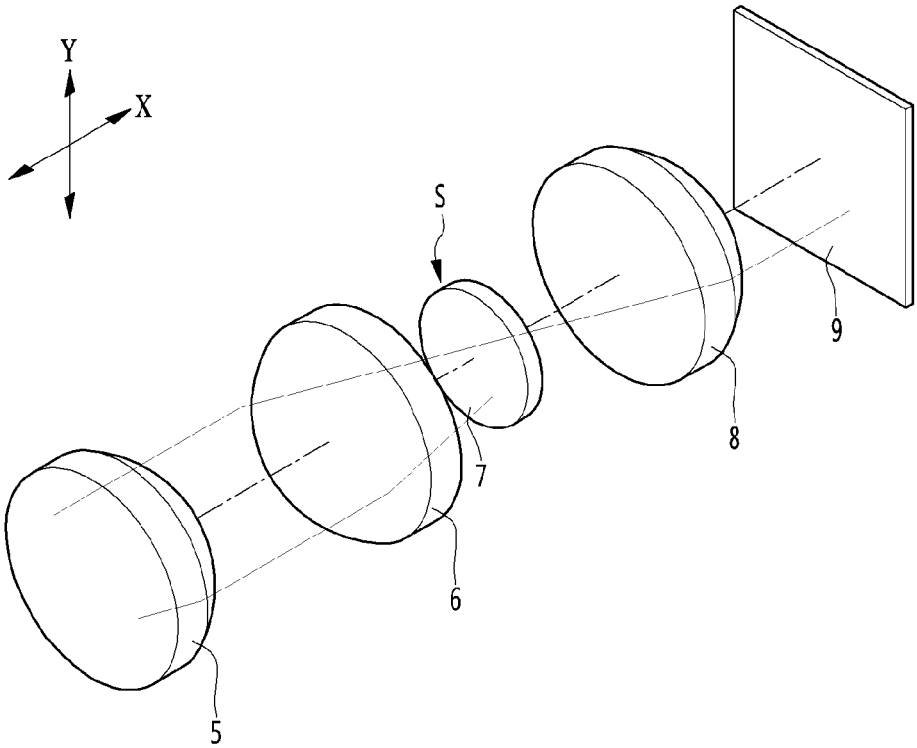
FIG. 6 is a perspective view illustrating a configuration of the lighting device for a vehicle according to the first implementation of the present disclosure.
Figure 7A:
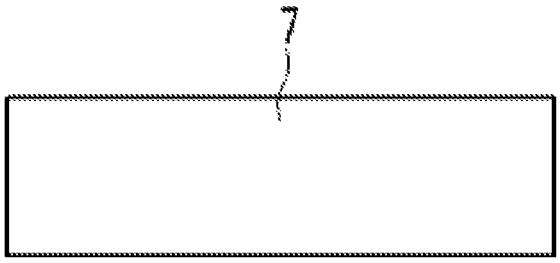
FIGS. 7A-7B are conceptual views illustrating an example of a plane shield and a resulting image formed on a screen.
Figure 7B:
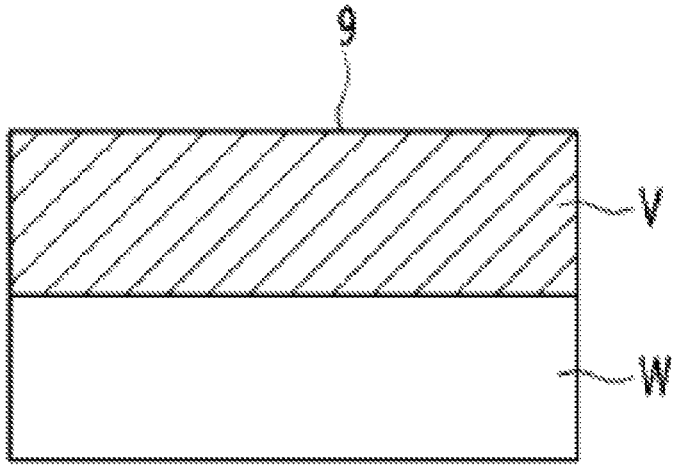
Figure 8A:
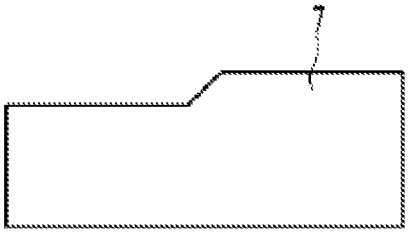
FIGS. 8A-8B are conceptual views illustrating an example of a cutoff shield and a resulting image formed on a screen.
Figure 8B:
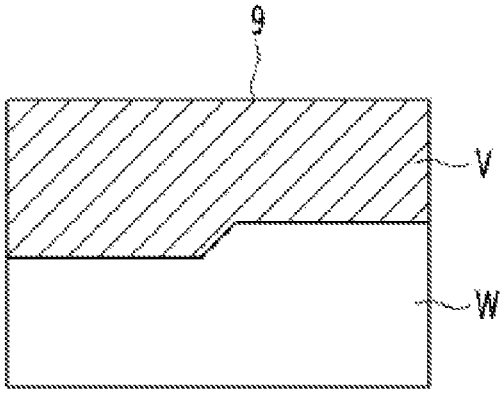

FIG. 6 illustrates a configuration of the lighting device for a vehicle according to the first implementation of the present disclosure; FIGS. 7A-7B illustrate an example of a plane shield and a resulting image formed on a screen; and FIGS. 8A-8B illustrate an example of a cutoff shield and a resulting image formed on a screen.

FIG. 6 illustrates the collimator lens 5, the focusing lens 6, the shield 7, the projection lens 8, and the screen 9. Various light distribution patterns may be formed according to a shape of the shield 7 disposed at the image forming plane S. Such light distribution patterns can be viewed by placing the screen 9 in front of the projection lens 8.

Referring to FIG. 7A, a shield 7 having a rectangular shape ("plane shield") is illustrated. Referring to FIG. 7B, an image which is formed when the shield 7 is arranged in the light distribution part 300 is illustrated. By placing the plane shield 7 at the image forming plane S of the focusing lens 6, a light distribution characteristic illustrated in FIG. 7B may be viewed on the screen 9.

A region in which light is shielded by the plane shield 7 may be region V in the screen 9, and the region V is accordingly a dark region. A region in which light is not shielded by the plane shield 7 may be region W in the screen 9, and the region W is accordingly a bright region.

Referring to FIG. 8A, a shield 7 formed by removing a part of the plane shield ("cutoff shield") is illustrated. Referring to FIG. 8B, an image which is formed when the cutoff shield 7 is arranged at the imaging forming point S of the focusing lens 6 is illustrated. By placing the cutoff shield 7 at the image forming plane S of the focusing lens 6, a light distribution characteristic illustrated in FIG. 8B may be viewed on the screen 9.

A region in which light is shielded by the cutoff shield 7 may be region V in the screen 9, and the region V is accordingly a dark region. A region in which light is not shielded by the cutoff shield 7 may be region W in the screen 9, and the region W is accordingly a bright region. The region W may correspond to a low beam pattern, and the use of the cutoff shield 7 resulted in a corresponding cutoff line at the boundary between region V and region W.

Accordingly, by selecting a shape of the shield 7 based on a purpose of light distribution, it is possible to realize various patterns of light distribution, including a low beam pattern.

Figure 9:
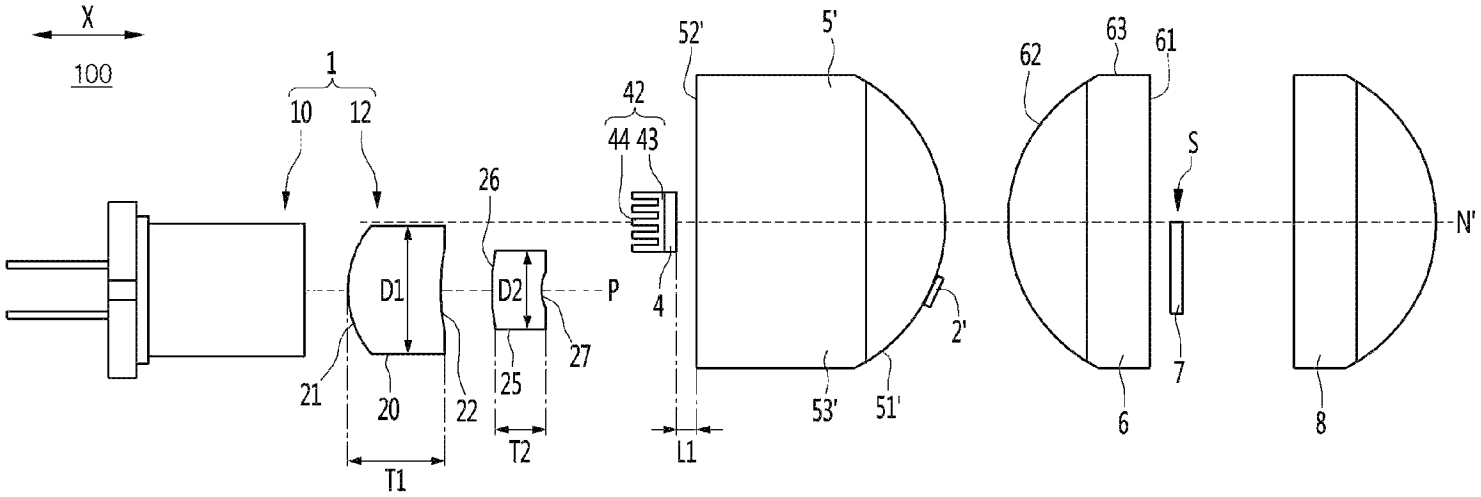
FIG. 9 is a configuration diagram illustrating an example of a lighting device for a vehicle according to a second implementation of the present disclosure.
Figure 10:
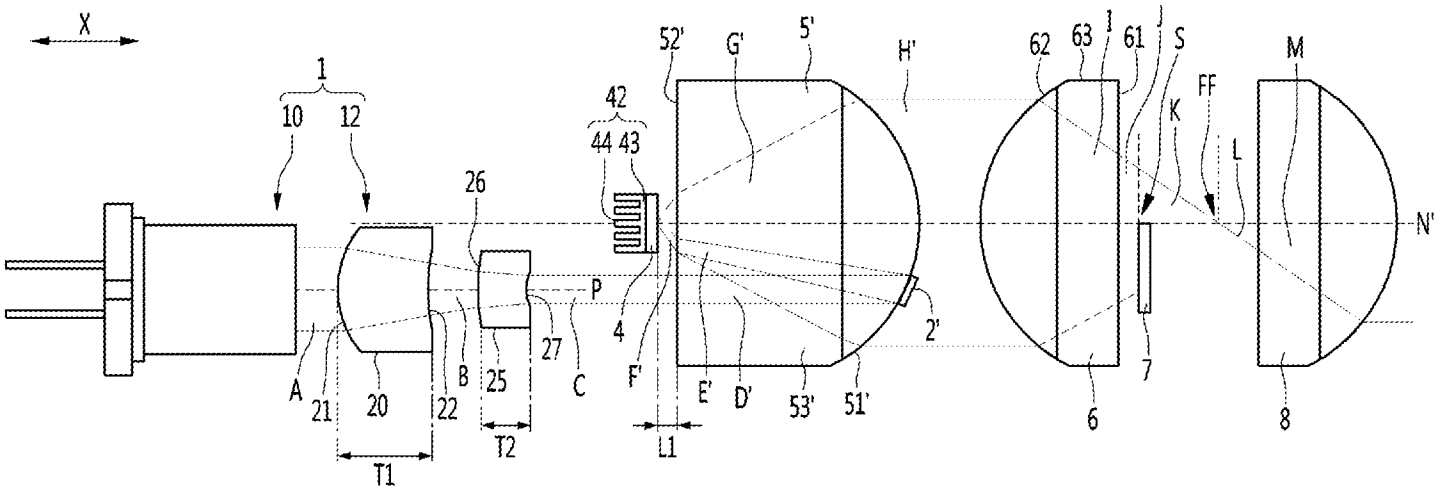
FIG. 10 is a configuration diagram illustrating optical paths in an example of a lighting device for a vehicle according to the second implementation of the present disclosure.

FIG. 9 illustrates an example of a lighting device for a vehicle according to a second implementation of the present disclosure; and FIG. 10 illustrates optical paths in an example of a lighting device for a vehicle according to the second implementation of the present disclosure.

Hereinafter, a second implementation of a lighting device for a vehicle will be described with respect to its differences from the first implementation.

In the lighting device according to the first implementation, the lens 3 having a reflection unit and the collimator lens 5 were separate from each other. In contrast, the lighting device according to the second implementation may use a single lens to implement functions of the lens 3 and the collimator lens 5.

A collimator lens 5' according to the second implementation may be thicker than the collimator lens 5 according to the first implementation. Alternatively, a width of a circumferential surface 53' of the collimator lens 5' according to the second implementation may be greater than a width of the circumferential surface 53 of the collimator lens 5 according to the first implementation.

The collimator lens 5' according to the second implementation may include a reflection unit 2' on a front surface 51' thereof. Accordingly, the collimator lens 5' according to the second implementation may reflect light, incident on a rear surface 52', toward the reflective phosphor 4. In addition, the collimator lens 5' according to the second implementation may output light, emitted by the reflective phosphor 4 and incident on the rear surface 52' of the collimator lens 5', in the form of parallel light rays.

Hereinafter, operations of the lighting device according to the second implementation will be described in reference to FIG. 10, with respect to its differences from the first implementation.

Light A emitted by a light source is reduced in width while propagating through the first reducer lens 20, the air between the first reducer lens 20 and the second reducer lens 25, and the second reducer lens 25 in the respective order. Light C having a reduced width may be incident on the rear surface 52' of the collimator lens 5' in a direction parallel to the optical axis of the second reducer lens 25.

Light D' incident on the rear surface 52' of the collimator lens 5' propagates through the rear of the reflection unit 2' of the collimator lens 5' and is then incident on the rear surface of the reflection unit 2'. The light D may be reflected from the rear surface of the reflection unit 2' toward the rear surface 52' of the collimator lens 5' as light E'.

Light E' reflected by the reflection unit 2' may be reflected in a direction toward an optical axis N' of the collimator lens 5' and refracted by the rear surface 52' of the collimator lens 5'.

Light F' refracted by the rear surface 52' of the collimator lens 5' may propagate from the rear surface 52' of the collimator lens 5' to the reflective phosphor 4 to be incident on the reflective phosphor 4.

Then a wavelength of the light F' incident on the reflective phosphor 4 may be converted by the reflective phosphor 4, and white light may be emitted by the reflective phosphor 4 toward the rear surface 52' of the collimator lens 5'.

The light emitted by the reflective phosphor 4 toward the rear surface 52' of the collimator lens 5' may propagate through the collimator lens 5' as light G', when then may pass through and be refracted by the front surface 51' of the collimator lens 5'. The light G' is then output toward the front side of the collimator lens 5' in a direction parallel to the optical axis of the collimator lens 5'.

Light H' output toward the front of the collimator lens 5' may be parallel light rays. The light H' may then be incident on the focusing lens 6 through the rear surface 62 of the focusing lens 6 as light I.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A lighting device for a vehicle, comprising:

a light source part, comprising:

a light source configured to emit light;

a reflection unit configured to receive the light emitted by the light source;

a lens having a front surface and a rear surface opposite to the front surface, wherein the reflection unit is provided on a part of the front surface and the rear surface is configured to receive the light emitted by the light source; and a reflective phosphor disposed behind the rear surface of the lens and configured to convert a wavelength of the light reflected by the reflection unit and reflect the wavelength-converted light toward the lens; and a light distribution part, comprising:

a collimator lens disposed forward of the front surface of the lens to receive the wavelength-converted light from the lens, and configured to collimate the received light to form parallel light rays;

a focusing lens disposed forward of the collimator lens to receive light from the collimator lens and configured to concentrate the received light to form an image forming plane; and a shield disposed at the image forming plane and configured to block at least a part of the light passing through the image forming plane.

2. The lighting device according to claim 1, wherein an optical axis of the collimator lens and an optical axis of the focusing lens coincide with each other.

3. The lighting device according to claim 1, wherein the parallel light rays are parallel to an optical axis of the collimator lens.

4. The lighting device according to claim 1, wherein the parallel light rays are parallel to an optical axis of the focusing lens.

5. The lighting device according to claim 1, wherein the focusing lens has a convex rear surface and a flat front surface, and wherein the shield is oriented parallel to the front surface of the focusing lens.

6. The lighting device according to claim 1, wherein the shield is disposed to face a lower portion of a front surface of the focusing lens.

7. The lighting device according to claim 1, wherein the shield is smaller than the focusing lens.

8. The lighting device according to claim 1, further comprising a projection lens disposed in front of the focusing lens, the projection lens having a convex front surface.

9. The lighting device according to claim 8, wherein the image forming plane is positioned between the projection lens and the focusing lens.

10. The lighting device according to claim 9, wherein the collimator lens, the focusing lens, and the projection lens have respective optical axes that coincides with one another.

* * * * *